US006857720B2

(12) United States Patent
Koller et al.

(10) Patent No.: US 6,857,720 B2
(45) Date of Patent: Feb. 22, 2005

(54) AIRFLOW ASSEMBLY FOR FLUID-EJECTION MECHANISM

(75) Inventors: Kevin David Koller, Vancouver, WA (US); Dale D Johnson, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/464,199

(22) Filed: Jun. 18, 2003

(65) Prior Publication Data

US 2004/0257395 A1 Dec. 23, 2004

(51) Int. Cl.[7] ..... B41J 2/165
(52) U.S. Cl. ..... 347/22; 347/25
(58) Field of Search ..... 347/22, 25, 34, 347/83

(56) References Cited

U.S. PATENT DOCUMENTS 4,185,290 A 1/1980 Hoffman
4,321,607 A 3/1982 Heibein et al.
5,258,774 A 11/1993 Rogers
6,561,620 B2 * 5/2003 Pietrzyk et al. ..... 347/34

FOREIGN PATENT DOCUMENTS

JP 11-001001 * 6/1999

* cited by examiner

*Primary Examiner*—Shih-Wen Hsieh

(57) ABSTRACT

An airflow assembly for a fluid-ejection mechanism of one embodiment of the invention is disclosed that includes at least one first surface and at least one second surface. The at least one first surface is to at least substantially cause airflow to be deflected around the fluid-ejection mechanism while the fluid-ejection mechanism is moving. The at least one second surface is at least substantially flush with a front surface of the fluid-ejection mechanism, to create airflow drag over the front surface of the fluid-ejection mechanism while the fluid-ejection mechanism is moving.

37 Claims, 12 Drawing Sheets

AIRFLOW ASSEMBLY FOR FLUID-EJECTION MECHANISM

BACKGROUND OF THE INVENTION

Inkjet printers have become popular for printing on media, especially when precise printing of color images is needed. For instance, such printers have become popular for printing color image files generated using digital cameras, for printing color copies of business presentations, and so on. An inkjet printer is more generically a fluid-ejection device that ejects fluid, such as ink, onto media, such as paper.

Inkjet printers have become increasingly faster at printing on media. One way in which they have become faster is that their inkjet printheads, which are more generally fluid-ejection mechanisms, move more quickly over media swaths, ejecting ink as they move from one end of a swath of media to the other end of the swath. However, increased printing speed can result in the formation of undesirable artifacts on the media.

For example, undesired so-called "worms" can result from quickly moving an inkjet printhead that is ejecting ink across a swath of media. Airflow that rushes past the printhead between the printhead and the media, as the printhead is moving across the media, affects the ink that the printhead is ejecting. The effect of this airflow on the ink is that it may cause discernable trails of ink on the media, or "worms."

SUMMARY OF THE INVENTION

An airflow assembly for a fluid-ejection mechanism of one embodiment of the invention includes at least one first surface and at least one second surface. The at least one first surface is to at least substantially cause airflow to be deflected around the fluid-ejection mechanism while the fluid-ejection mechanism is moving. The at least one second surface is at least substantially flush with a front surface of the fluid-ejection mechanism, to create airflow drag over the front surface of the fluid-ejection mechanism while the fluid-ejection mechanism is moving.

BRIEF DESCRIPTION OF THE DRAWINGS

The drawings referenced herein form a part of the specification. Features shown in the drawing are meant as illustrative of only some embodiments of the invention, and not of all embodiments of the invention, unless otherwise explicitly indicated, and implications to the contrary are otherwise not to be made.

DETAILED DESCRIPTION OF THE DRAWINGS

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Airflow Assembly for Fluid-Ejection Mechanism

Figure 1:
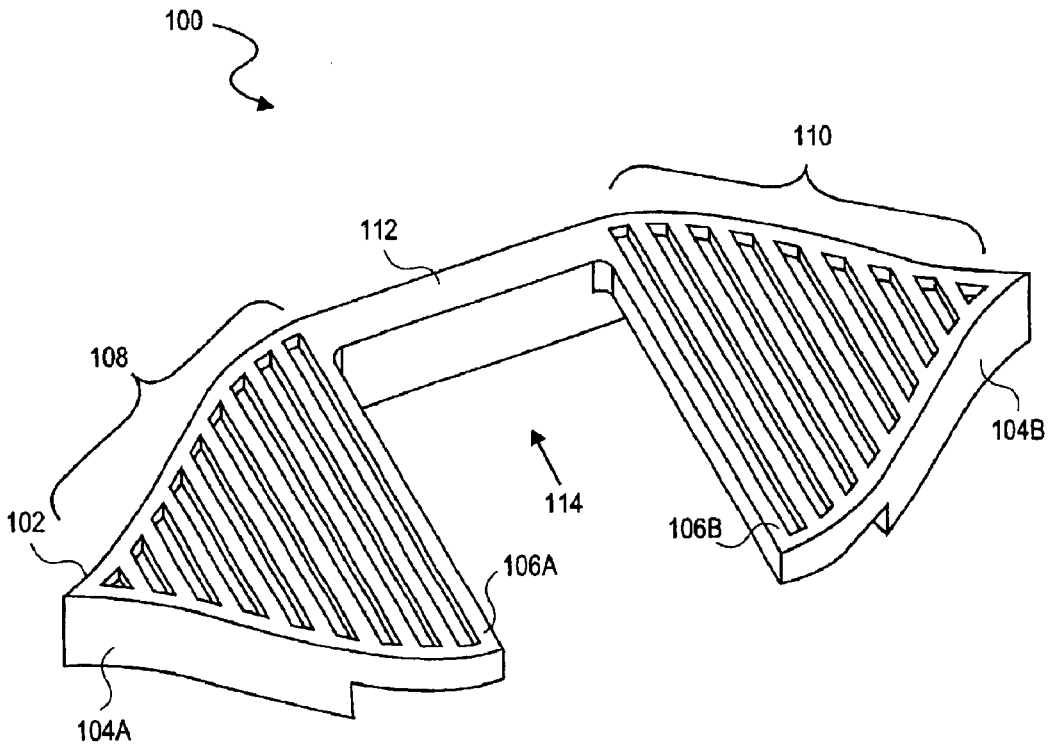
FIG. 1 is a diagram of an airflow assembly for a fluid-ejection mechanism, according to an embodiment of the invention.

FIG. 1 shows an airflow assembly 100 for a fluid-ejection mechanism, such as an inkjet printhead, according to an embodiment of the invention. The airflow assembly 100 of FIG. 1 includes a single component 102 having a number of surfaces, including the surfaces 104A, 104B, 106A, and 106B. The surfaces 104A and 104B are collectively referred to as the surfaces 104, and the surfaces 106A and 106B are collectively referred to as the surfaces 106. The surfaces 104 are perpendicular to the surfaces 106. The airflow assembly 100 further includes a bridge section 112 and an area 114 in which the fluid-ejection mechanism may be attached.

Each of the surfaces 104 is at least substantially teardrop-shaped. As will be described, the surfaces 104 are aerodynamically efficient leading surfaces of the airflow assembly 100 that cause airflow to go around a fluid-ejection mechanism mounted within the area 114 while the fluid-ejection mechanism is moving. That is, the surfaces 104 each divide or divert airflow around the fluid-ejection mechanism mounted within the area 114, and thus minimize airflow over the fluid-ejection mechanism, while the fluid-ejection mechanism is moving.

The surface 106A includes a number of parallel ribs 108 and the surface 106B includes a number of parallel ribs 110.

As will be described, the surfaces 106, and particularly their ribs 108 and 110, create airflow drag over a front surface of the fluid-ejection mechanism mounted within the area 114 while the fluid-ejection mechanism is moving. That is, the surfaces 106 are drag-inducing surfaces that slow airflow over the fluid-ejection mechanism mounted within the area 114, and thus maximize airflow drag over the fluid-ejection mechanism, while the fluid-ejection mechanism is moving. This has the effect of matching the speed of the standing air that the fluid-ejection mechanism is moving through to the speed of the mechanism, allowing the fluid drops to travel to the media without the airflow affecting their trajectory, and causing them to be placed at the expected location.

Figure 2:
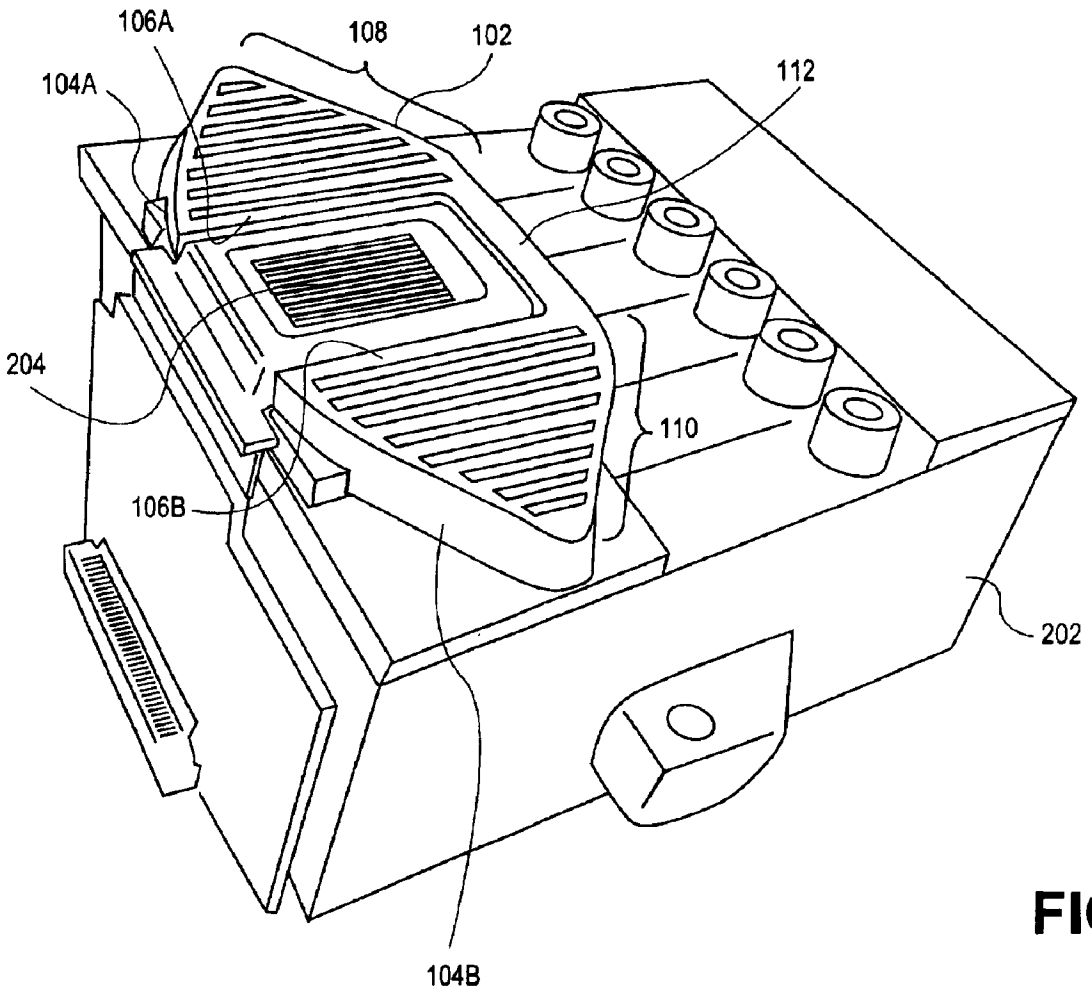
FIG. 2 is a diagram of an airflow assembly attached to a fluid-ejection mechanism, according to an embodiment of the invention.

FIG. 2 shows a fluid-ejection mechanism 202 attached within the airflow assembly 100, according to an embodiment of the invention. The fluid-ejection mechanism 202 is specifically depicted as inkjet printhead that can eject ink, but may be another type of fluid-ejection mechanism that can eject another type of fluid. The fluid-ejection mechanism 202 specifically includes a front surface 204 that is at least substantially flush with the surfaces 106 of the airflow assembly 100.

Figure 3:
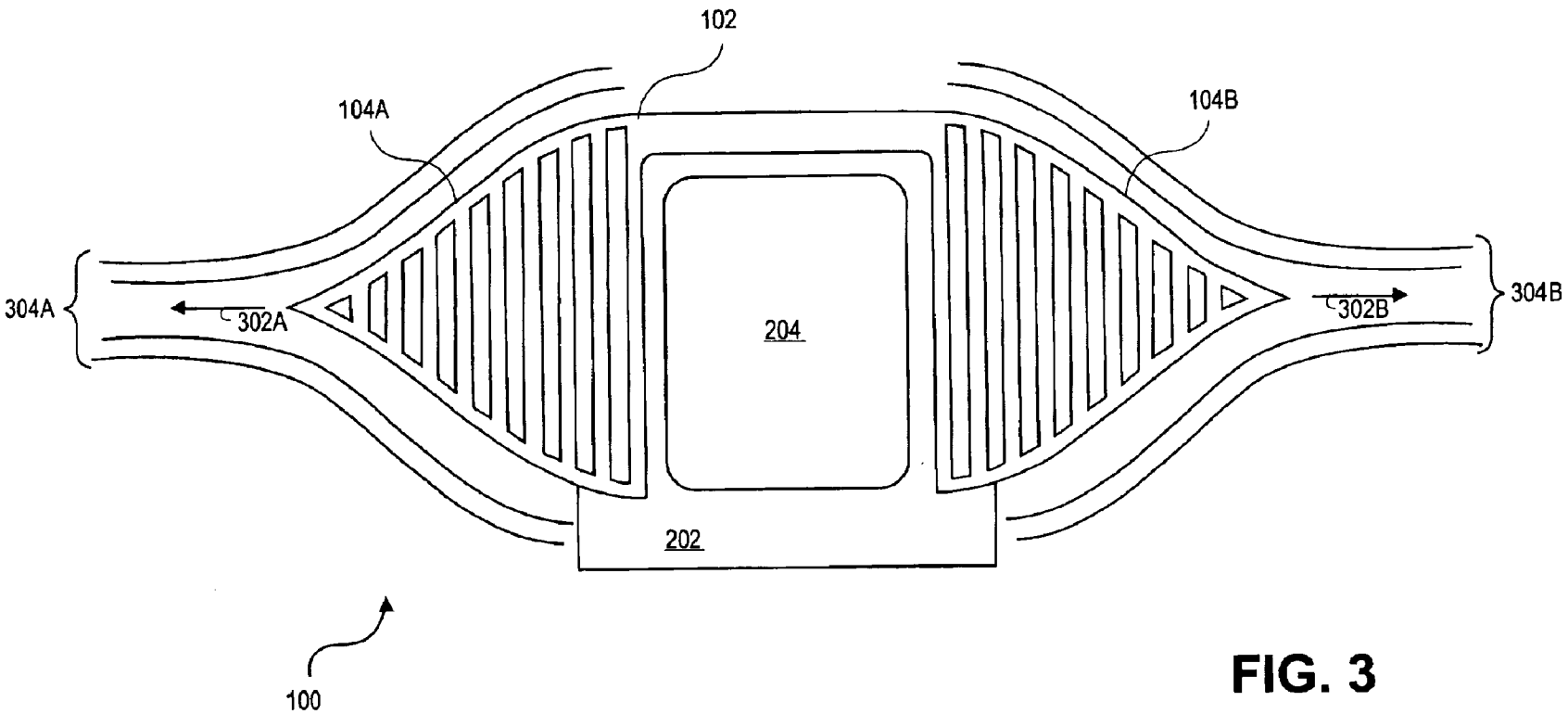
FIG. 3 is a diagram of a top view of an airflow assembly for a fluid-ejection mechanism that shows how surfaces of the airflow assembly cause airflow to at least substantially go around the mechanism, according to an embodiment of the invention.

FIG. 3 is a top view of the airflow assembly 100 that shows how the surfaces 104 cause airflow to go around the fluid-ejection mechanism 202 while the mechanism 202 is moving, according to an embodiment of the invention. While the assembly 100 and the mechanism 202 are traveling in the direction indicated by the arrow 302A, the surface 104A is a leading surface oriented in the direction of movement of the mechanism 202. Airflow, represented by the lines 304A, thus is diverted or divided, and goes around the fluid-ejection mechanism 202 while the mechanism 202 is moving and ejecting fluid.

Similarly, while the assembly 100 and the mechanism 202 are traveling in the direction indicated by the arrow 302B, which is opposite to the direction indicated by the arrow 302A, the surface 104B is a leading surface oriented in the direction of movement of the mechanism 202. Airflow, represented by the lines 304B, is diverted or divided, and goes around the fluid-ejection mechanism 202 while the mechanism 202 is moving and ejecting fluid. Therefore, the surfaces 104 minimize airflow over the fluid-ejection mechanism 202 while the mechanism 202 is moving and ejecting fluid.

Figure 4:
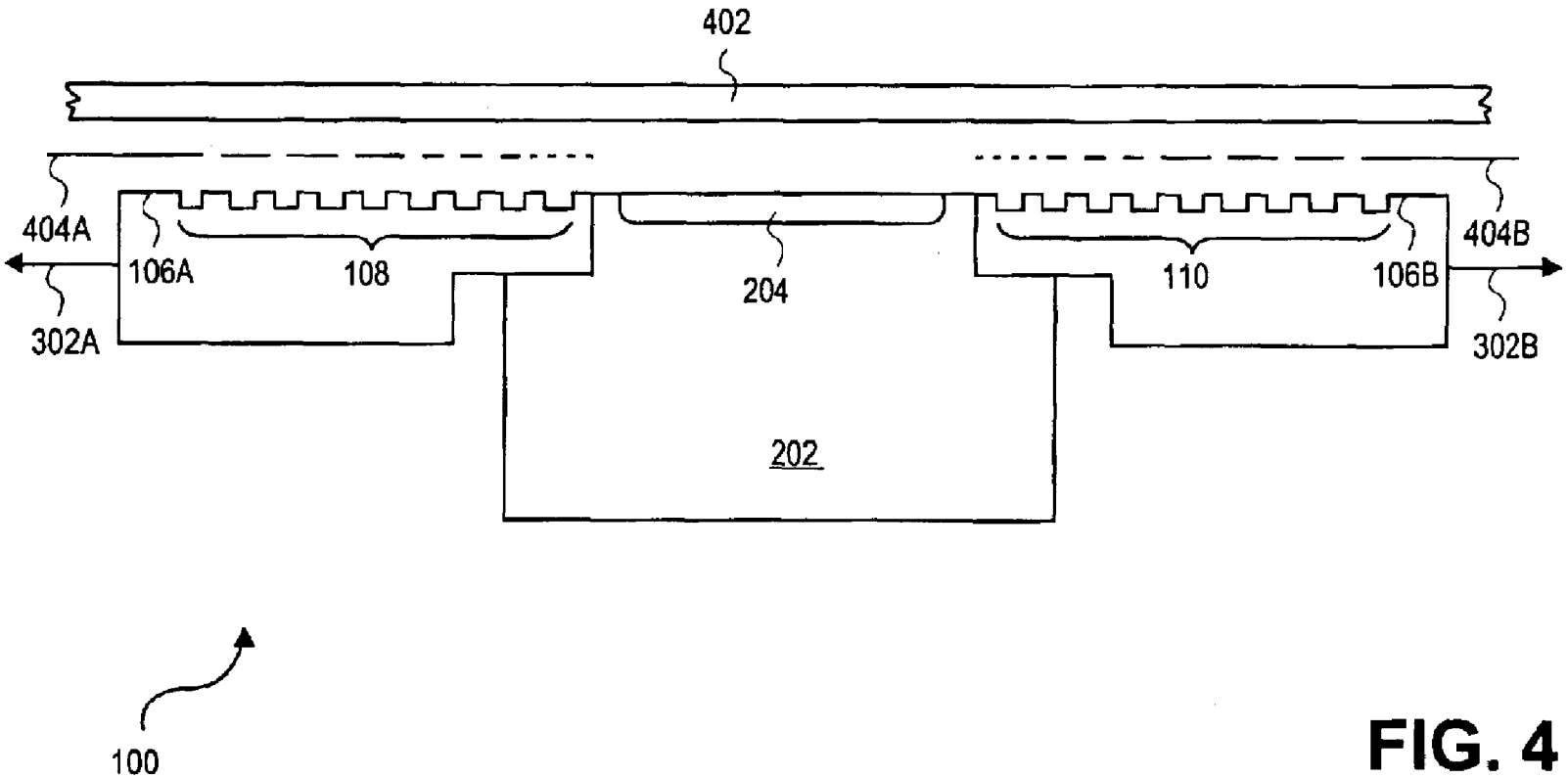
FIG. 4 is a diagram of a cross-sectional front view of an airflow assembly for a fluid-ejection mechanism that shows how surfaces of the airflow assembly create airflow drag over a front surface of the mechanism, according to an embodiment of the invention.

FIG. 4 is a cross-sectional front view of the airflow assembly 100 that shows how the surfaces 106 creates airflow drag over the front surface 204 of the fluid-ejection mechanism 202 while the mechanism 202 is moving, according to an embodiment of the invention. The airflow assembly 100 and the mechanism 202 is positioned under media 402, such as paper, on which the mechanism 202 ejects fluid while it is moving in the direction 302A and/or the direction 302B. The airflow assembly 100 and the mechanism 202 may also be positioned over the media 402, or in another orientation with respect to the media 402. While the assembly 100 and the mechanism 202 are traveling in the direction indicated by the arrow 302A, the surface 106A and its ribs 108 are positioned before the front surface 204 of the mechanism 202. Airflow, represented by the line 404A, thus is slowed relative to the mechanism 202, as it travels over the ribs 108 of the surface 106A, as indicated by the increasingly shorter dashes of the line 404A, as compared to the scenario where the assembly 100 is not employed. That is, although the airflow is actually increased in speed to match the speed of the mechanism 202, from the perspective of the mechanism 202, the airflow is decreased in speed to what it would be if the assembly 100 were not used.

Similarly, while the assembly 100 and the mechanism 202 are traveling in the direction indicated by the arrow 302B, the surface 106B and its ribs 110 are positioned before the front surface 204 of the mechanism 202. Airflow, represented by the line 404B, is slowed as it travels over the ribs 110 of the surface 106B relative to if the ribs 110 were not present, as indicated by the increasingly shorter dashes of the line 404B. Therefore, the surfaces 106 create or maximize airflow drag over the front surface 204 of the fluid-ejection mechanism 202 while the mechanism 202 is moving and ejecting fluid onto the media 402.

Figure 5A:
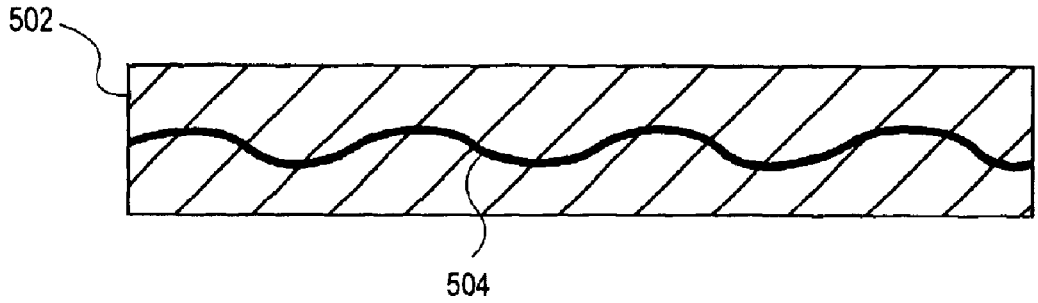
FIGS. 5A and 5B are diagrams showing how undesired artifacts known as "worms" are substantially eliminated by utilizing an airflow assembly attached to a fluid-ejection mechanism, according to an embodiment of the invention.
Figure 5B:
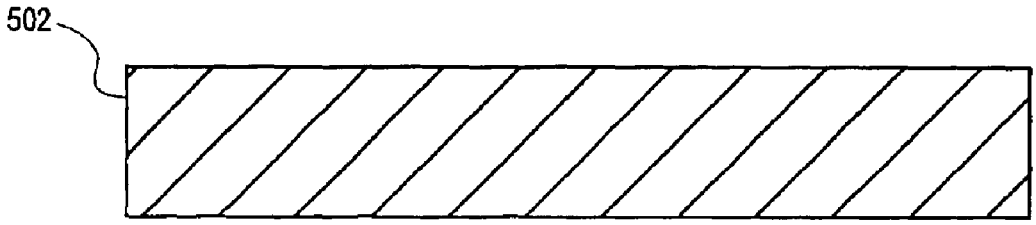

FIGS. 5A and 5B exemplarily depict how the airflow assembly 100 at least substantially reduces undesired airflow-caused fluid-ejection artifacts on a swath of media 502 while the fluid-ejection mechanism 202 is moving relative to and ejecting fluid on the media swath 502, according to an embodiment of the invention. In FIG. 5A, the media swath 502 results from fluid being ejected thereon by the mechanism 202, where the airflow assembly 100 is not attached to the mechanism 202. As a result, an undesired fluid-ejection artifact 504, which is known as a "worm," can occur.

It is noted that such a worm artifact is not additional fluid on the media swath 502, but rather is a defect caused by fluid drop placement errors that have a particular pattern. A worm artifact is visible because the airflow currents cause the drops to be misplaced in a way that distorts the image so that patterns in the output are visible. Therefore, a worm artifact is a specific type of defect caused by aerodynamic effects on the fluid drops that tend to be easily discerned when performing certain types of fluid-ejection tests. It is noted that aerodynamic effects can also cause other types of defects, such as graininess in the resulting image output on media, that the assembly 100 also prevents.

By comparison, in FIG. 5B, the media swath 502 results from fluid being ejected thereon by the fluid-ejection mechanism 202, where the airflow assembly 100 is attached to the mechanism 202. The artifact 504 does not occur, due to the surfaces 104 and 106 of the airflow assembly 100 affecting the airflow over the fluid-ejection mechanism 202 as has been described. Therefore, the airflow assembly 100 at least substantially prevents undesired airflow-caused fluid-ejection artifacts, like the artifact 504.

Alternative Embodiments of Airflow Assembly

Figure 6:
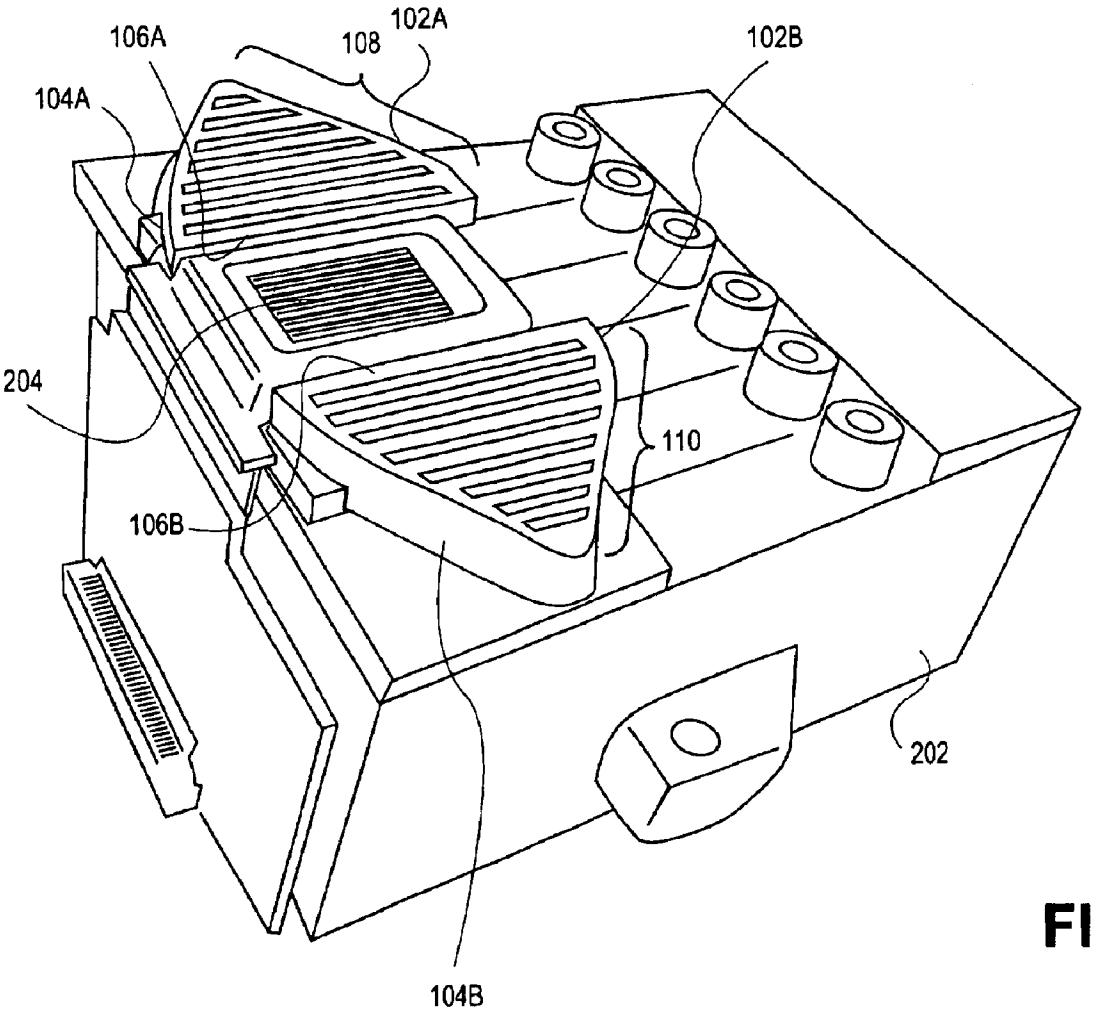
FIG. 6 is a diagram of an airflow assembly for a fluid-ejection mechanism that has two separate components, according to an embodiment of the invention.

FIG. 6 shows the airflow assembly attached to the fluid-ejection mechanism 202, according to an alternative embodiment of the invention. Whereas the assembly 100 of FIGS. 1 and 2 has a single component 102 that includes the surfaces 104 and 106, the assembly in FIG. 6 has two components 102A and 102B that encompass the surfaces 104 and 106. Specifically, the component 102A includes the surfaces 104A and 106A, whereas the component 102B includes the surfaces 104B and 106B. The bridge section 112 of the assembly 100 of FIGS. 1 and 2 is omitted from the assembly of FIG. 6. Each of the components 102A and 102B is attached to an opposite side of the mechanism 202.

Figure 7:
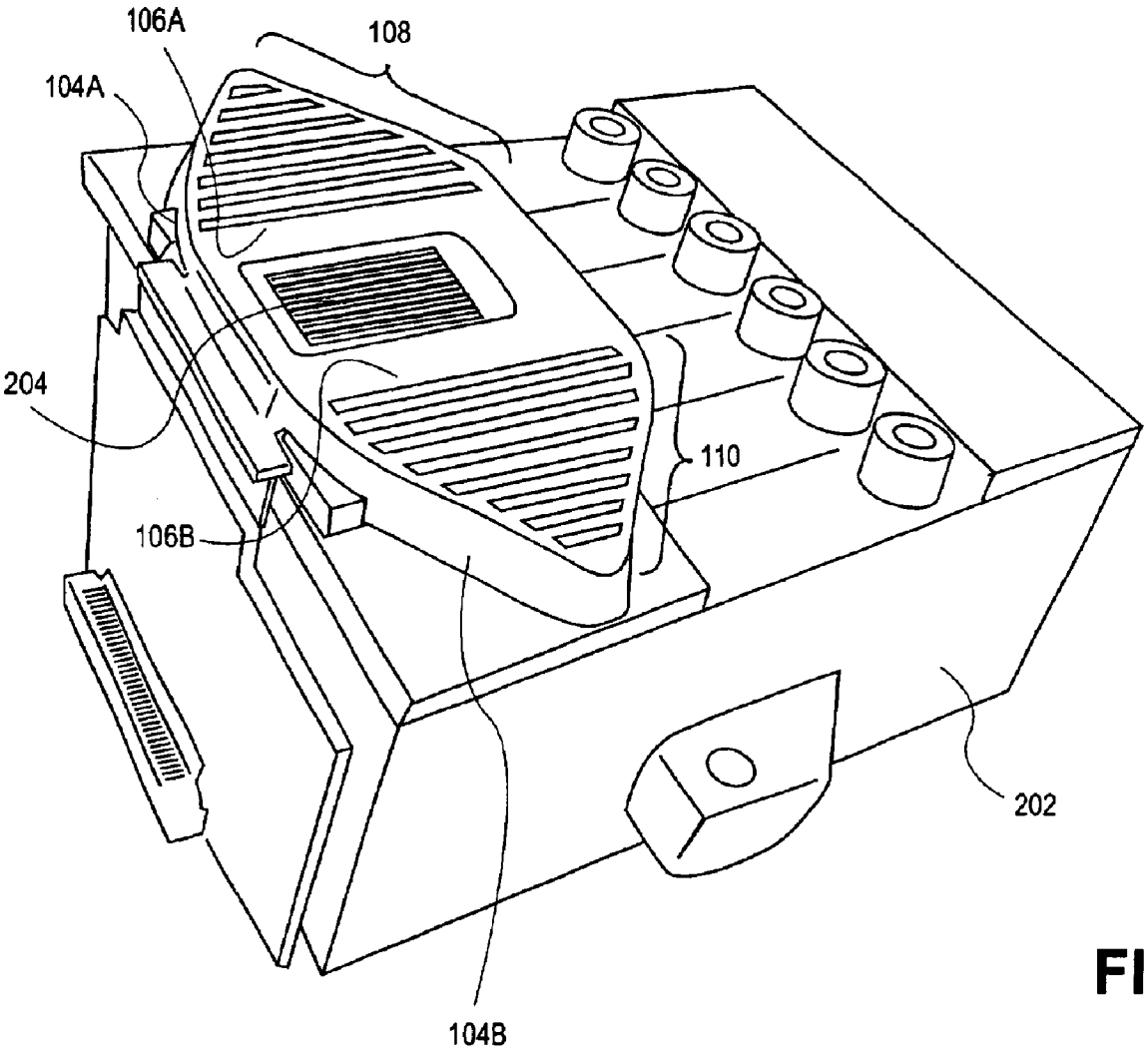
FIG. 7 is a diagram of a fluid-ejection mechanism that has an integral airflow assembly, according to an embodiment of the invention.

FIG. 7 shows the fluid-ejection mechanism 202 to which the airflow assembly is integral, according to another alternative embodiment of the invention. The assembly 100 of FIGS. 1, 2, and 6 has one or two components 102 that are separate from and attached to the fluid-ejection mechanism 202. By comparison, the assembly of FIG. 7 is actually part of the fluid-ejection mechanism 202. The airflow assembly is not attached to the fluid-ejection mechanism 202, inasmuch as the assembly is integral to the mechanism 202.

Figure 8A:
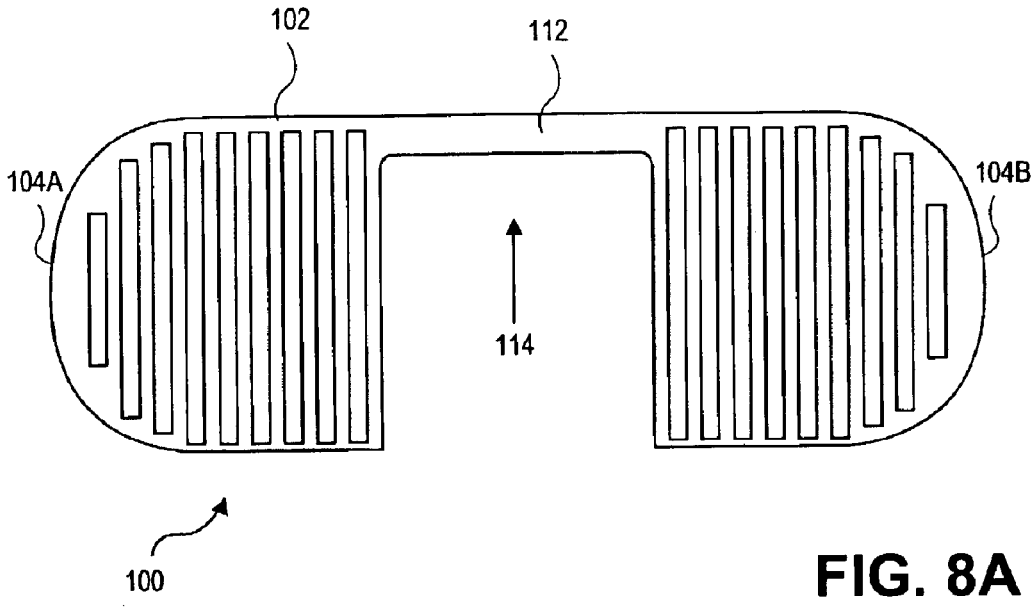
FIGS. 8A and 8B are diagrams of top views of an airflow assembly for a fluid-ejection mechanism that show different surfaces of the airflow assembly that cause airflow to at least substantially go around the mechanism, according to varying embodiments of the invention.
Figure 8B:
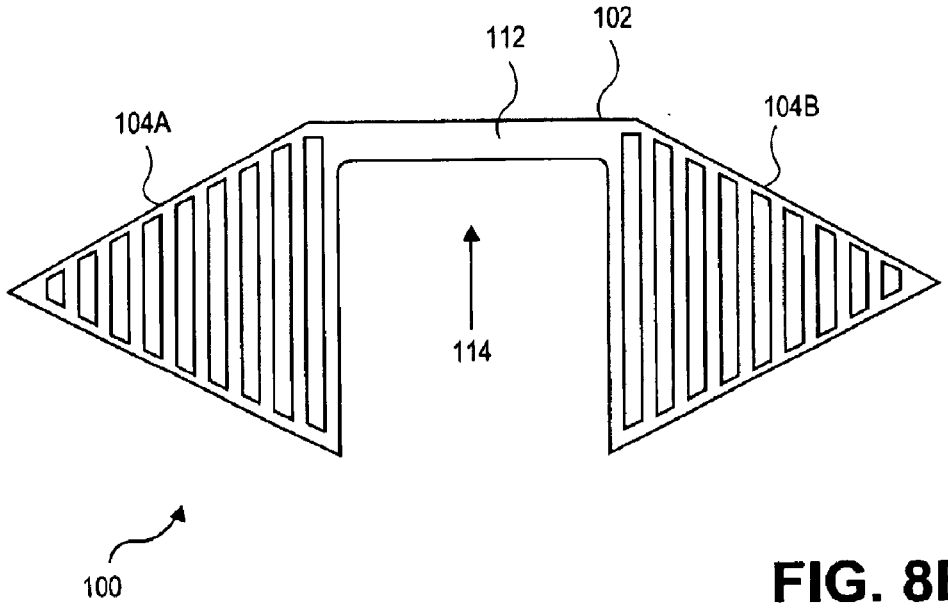

FIGS. 8A and 8B show top views of the airflow assembly 100, according to varying embodiments of the invention.

The assembly 100 has been described as having the surfaces 104 as aerodynamically efficient leading surfaces. The surfaces 104 have been depicted in FIGS. 1–7 as teardrop-shaped. However, the aerodynamically efficient leading surfaces 104 can have shapes other than teardrops in other embodiments of the invention. In FIG. 8A, the surfaces 104 of the assembly 100 are nosecone-shaped, whereas in FIG. 8B, the surfaces 104 of the assembly 100 are triangular in shape.

Figure 9A:
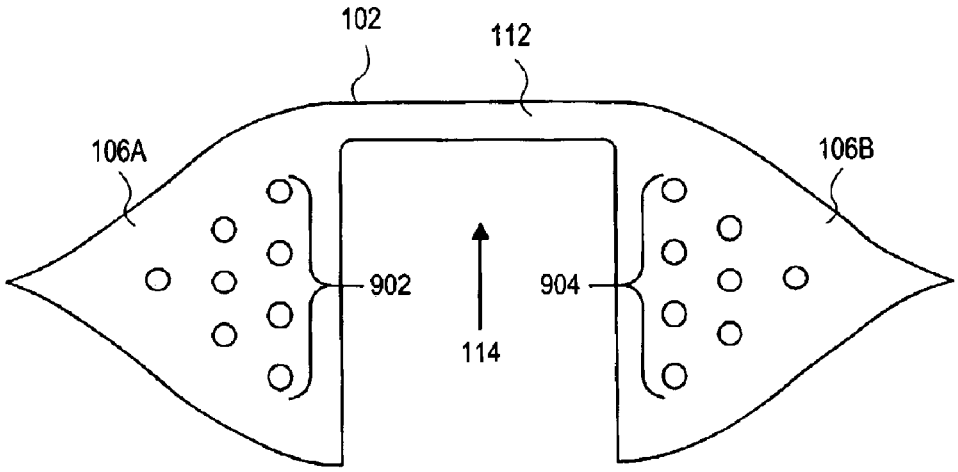
FIGS. 9A and 9B are diagrams of top views of an airflow assembly for a fluid-ejection mechanism that show different surfaces of the airflow assembly that create airflow drag over a front surface of the mechanism, according to varying embodiments of the invention.
Figure 9B:
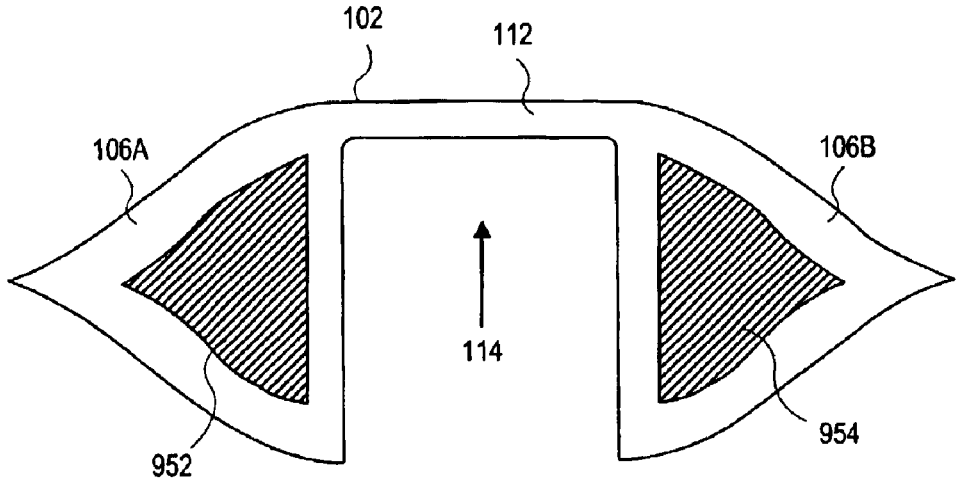

FIGS. 9A and 9B show top views of the airflow assembly 100, according to further varying embodiments of the invention. The assembly 100 has been described as having the surfaces 106 as drag-inducing surfaces. The surfaces 104 have been depicted in FIGS. 1–7 as having parallel ribs 108 and 110. However, the surfaces 104 can create drag other than by inclusion of the parallel ribs 108 and 110. For instance, the ribs 108 and 110 may not parallel to one another, or may be otherwise situated differently than depicted in FIGS. 1–7. Further, in FIG. 9A, the surfaces 104 include a number of posts 902 and 904 to cause airflow drag, in lieu of the ribs 108 and 110. In FIG. 9B, the surfaces 104 are shown as being rough or roughened, as indicated by the shaded areas 952 and 954, to cause airflow drag, in lieu of the ribs 108 and 110.

Fluid-Ejection Device and Methods

Figure 10:
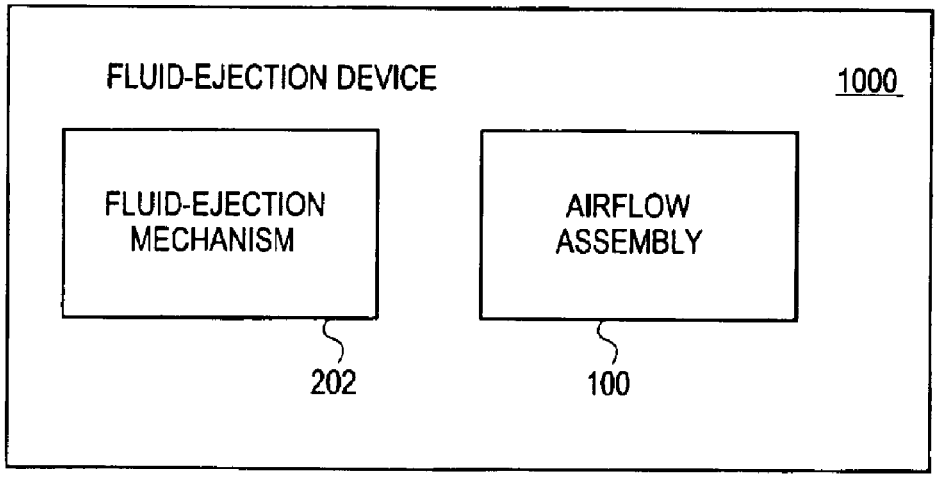
FIG. 10 is a block diagram of a fluid-ejection device, according to an embodiment of the invention.

FIG. 10 shows a block diagram of a fluid-ejection device 1000, according to an embodiment of the invention. The fluid-ejection device 1000 includes the fluid-ejection mechanism 202 and the airflow assembly 100. The fluid-ejection mechanism 202 may be an inkjet-printing mechanism in one embodiment, such as an inkjet printhead, such that the fluid-ejection device 100 may be an inkjet-printing device, such as an inkjet printer. The airflow assembly 100 can include one or two components 102, as depicted in FIGS. 1 and 6, as have been described. The airflow assembly 100 can also be integral to the fluid-ejection mechanism 202, as depicted in FIG. 7, as has been described.

Figure 11:
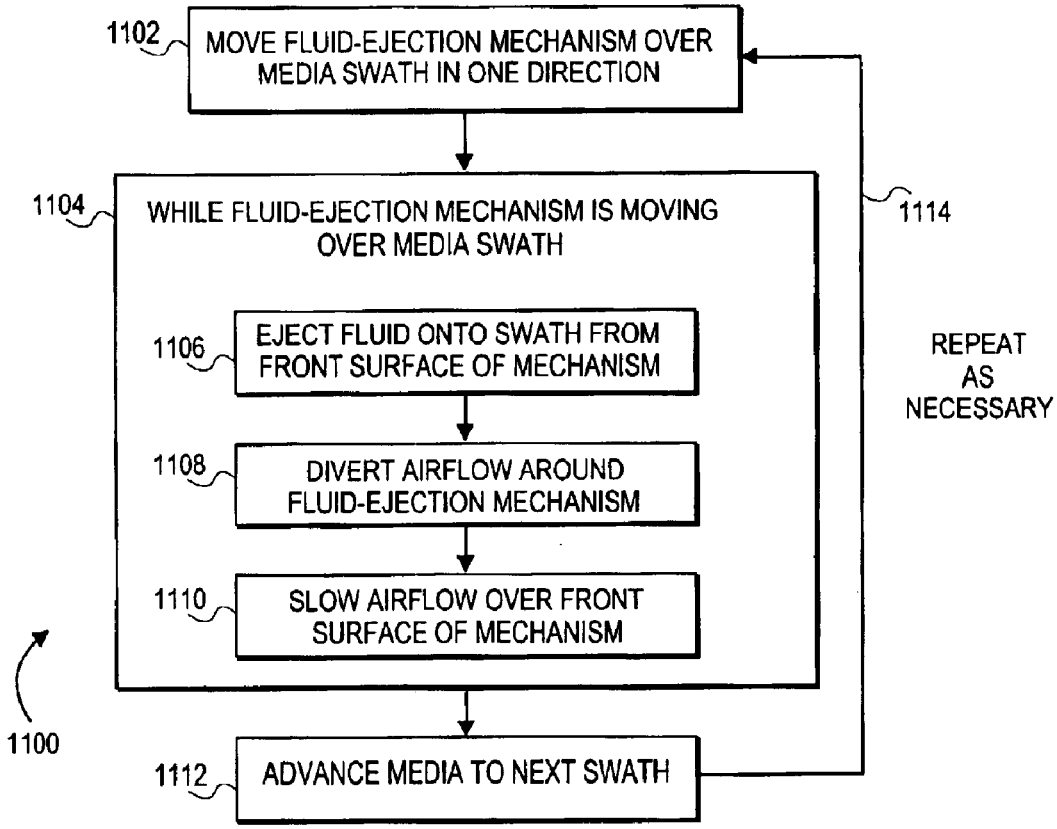
FIG. 11 is a flowchart of a method of use, according to an embodiment of the invention.

FIG. 11 shows a method of use 1100, according to an embodiment of the invention. For instance, the method 1100 may be performed in conjunction with the airflow assembly 100 and the fluid-ejection mechanism 202 that have been described. First, the fluid-ejection mechanism 202 is moved over a swath of media in one direction (1102). While the fluid-ejection mechanism 202 is moving over the media swath (1104), fluid is ejected from the front surface 204 of the mechanism 202 (1106). For instance, ink may be ejected, where the mechanism 202 is an inkjet printhead or another type of inkjet-printing mechanism.

Airflow is diverted, or divided, around the fluid-ejection mechanism 202 (1108), such as by the surfaces 104 of the airflow assembly 100. In addition, airflow is relatively slowed over the front surface 204 of the mechanism 202 (1110), such as by the surfaces 106 of the assembly 100. That is, airflow drag is created over the front surface 204 of the mechanism 202. The media is then advanced to the next swath (1112), and the method 1100 is repeated as necessary (1114) to eject fluid over the media as desired. Each time the method 1100 is repeated, the direction in which the fluid-ejection mechanism 202 is moved over the current media swath in 1102 may alternate, such as going from left to right to going from right to left.

Figure 12A:
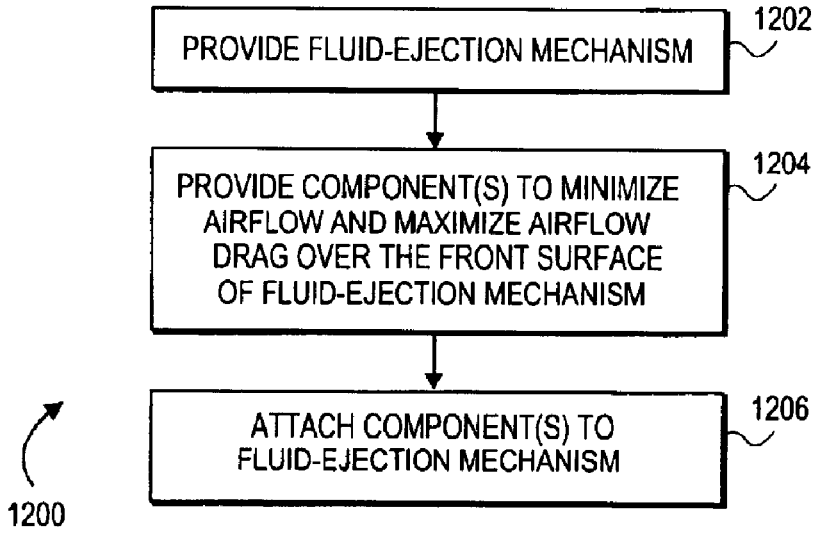
FIGS. 12A and 12B are flowcharts of methods of manufacture, according to varying embodiments of the invention.
Figure 12B:
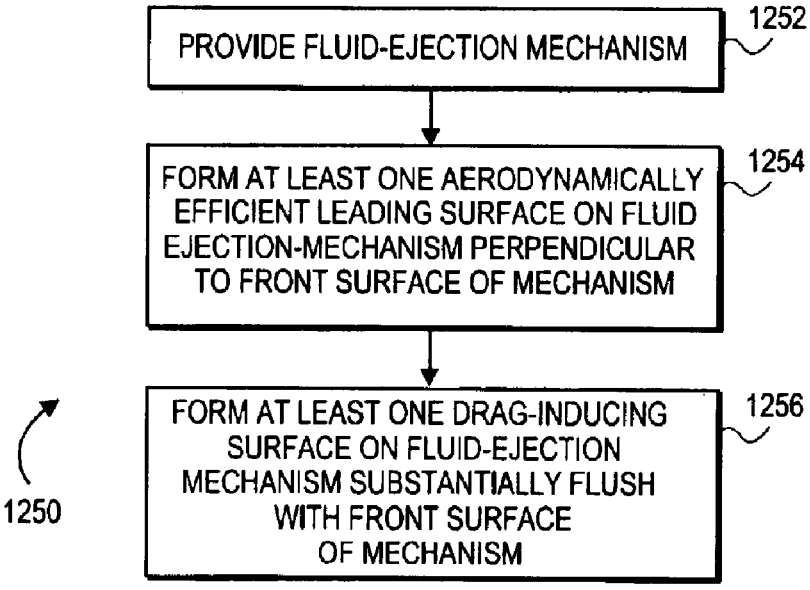

FIGS. 12A and 12B show methods of manufacture 1200 and 1250, according to varying embodiments of the invention. The method 1200 may be for manufacturing the fluid-ejection mechanism 202 and the airflow assembly 100 as the assembly 100 is depicted in FIG. 1 or FIG. 6, whereas the method 1250 may be for manufacturing the fluid-ejection mechanism 202 including the integral airflow assembly 100 of FIG. 7. In FIG. 12A, the fluid-ejection mechanism 202 is first provided (1202). Next, one or two components 102 of the assembly 100 are provided that minimize airflow over the mechanism 202 and maximize airflow drag over the front surface 204 of the mechanism 202 (1204). Finally, the component(s) 102 are attached to the mechanism 202 (1206).

In FIG. 12B, the fluid-ejection mechanism 202 is again initially provided (1252). At least one aerodynamically efficient leading surface, such as the surfaces 104, is formed on the fluid-ejection mechanism 202, perpendicular to the front surface 204 of the fluid-ejection mechanism 202 (1254). Finally, at least one drag-inducing surface, such as the surfaces 106, is formed on the fluid-ejection mechanism 202, substantially flush with the front surface 204 of the fluid-ejection mechanism 202 (1256).

CONCLUSION

It is noted that, although specific embodiments have been illustrated and described herein, it will be appreciated by those of ordinary skill in the art that any arrangement is calculated to achieve the same purpose may be substituted for the specific embodiments shown. This application is intended to cover any adaptations or variations of the present invention. Therefore, it is manifestly intended that this invention be limited only by the claims and equivalents thereof.

We claim:

1. An airflow assembly for a fluid-ejection mechanism comprising:

at least one first surface to at least substantially cause airflow to be deflected around the fluid-ejection mechanism while the fluid-ejection mechanism is moving; and, at least one second surface at least substantially flush with a front surface of the fluid-ejection mechanism to create airflow drag over the front surface of the fluid-ejection mechanism while the fluid-ejection mechanism is moving, wherein the at least one first surface are aerodynamically efficient and/or each of the at least one second surface comprises at least one of: a plurality of ribs, a plurality of posts, and a rough surface.

2. The assembly of claim 1, further comprising a component of which the at least one first surface and the at least one second surface are a part.

3. The assembly of claim 2, wherein the fluid-ejection mechanism is attachable to the component.

4. The assembly of claim 1, further comprising a first component and a second component, the first component having one of the at least one first surface and one of the at least one second surface, the second component having another of the at least one first surface and another of the at least one second surface.

5. The assembly of claim 4, wherein the first component is attachable to one side of the fluid-ejection mechanism and the second component is attachable to another side of the fluid-ejection mechanism.

6. The assembly of claim 1, further comprising the fluid-ejection mechanism, such that the at least one first surface and the at least one second surface are integral to the fluid-ejection mechanism.

7. The assembly of claim 6, wherein the fluid-ejection mechanism is an inkjet printhead.

8. The assembly of claim 1, wherein the at least one first surface and the at least one second surface at least substantially prevent undesired fluid-ejection artifacts on media caused by airflow while the fluid-ejection mechanism is moving relative to the media on which the fluid-ejection mechanism is ejecting fluid.

9. The assembly of claim 1, wherein the at least one first surface is perpendicular to the at least one second surface.

10. The assembly of claim 1, wherein each of the at least one first surface has a shape selected from the group of shapes comprising: a teardrop shape, a nose-cone shape, and a triangular shape.

11. An airflow assembly for a fluid-ejection mechanism comprising:

means for causing airflow to at least substantially go around the fluid-ejection mechanism; and, means for creating airflow drag over a front surface of the fluid-ejection mechanism, by employing at least one of: a plurality of ribs, a plurality of posts, and a rough surface.

12. An airflow assembly for a fluid-ejection mechanism comprising at least one of:

at least one aerodynamically efficient leading surface oriented in a direction of movement of the fluid-ejection mechanism and positioned before the fluid-ejection mechanism while the fluid-ejection mechanism is moving and ejecting fluid; and, at least one drag-inducing surface each oriented at least substantially flush with a front surface of the fluid-ejection mechanism and positioned before the front surface of the fluid-ejection mechanism while the fluid-ejection mechanism is moving and ejecting fluid, wherein each drag-inducing surface comprises at least one of: a plurality of ribs, a plurality of posts, and a rough surface.

13. The assembly of claim 12, wherein the fluid-ejection mechanism ejects the fluid while traveling in one direction, the assembly including one aerodynamically efficient leading surface and one drag-inducing surface positioned before the fluid-ejection mechanism in the one direction.

14. The assembly of claim 12, wherein the fluid-ejection mechanism ejects the fluid while traveling in a first direction and in a second direction opposite to the first direction, the assembly including one aerodynamically efficient leading surface and one drag-inducing surface positioned before the fluid-ejection mechanism in the first direction and another aerodynamically efficient leading surface and another drag-inducing surface positioned before the fluid-ejection mechanism in the second direction.

15. The assembly of claim 12, further comprising a component attachable to the fluid-ejection mechanism and of which the at least one aerodynamically efficient leading surface and the at least one drag-inducing surface are a part.

16. The assembly of claim 12, further comprising the fluid-ejection mechanism, the at least one aerodynamically efficient leading surface and the at least one drag-inducing surface integral to the fluid-ejection mechanism.

17. The assembly of claim 12, wherein the at least one aerodynamically efficient leading surface and the at least one drag-inducing surface at least substantially reduce undesired fluid-ejection artifacts on media caused by airflow while the fluid-ejection mechanism is moving relative to the media on which the fluid-ejection mechanism is ejecting fluid.

18. An airflow assembly for a fluid-ejection mechanism comprising:

means for dividing airflow around the fluid-ejection mechanism; and, means for relatively slowing airflow over a front surface of the fluid-ejection mechanism, by employing at least one of a plurality of ribs, a plurality of posts, and a rough surface.

19. A fluid-ejection device comprising:

a fluid-ejection mechanism having a front surface from which fluid is ejected; and, a component attachable to the fluid-ejection mechanism to at least one of minimize airflow and maximize airflow drag over the front surface of the fluid-ejection mechanism, by employing at least one of: a plurality of ribs, a plurality of posts, and a rough surface.

20. The device of claim 19, wherein the component at least one of minimizes airflow and maximizes airflow drag over the front surface of the fluid-ejection mechanism while the mechanism is traveling in a first direction.

21. The device of claim 20, further comprising a second component to at least one of minimize airflow and maximize airflow drag over the front surface of the fluid-ejection mechanism while the mechanism is traveling in a second direction opposite to the first direction.

22. The device of claim 21, wherein each of the component and the second component comprises at least one of:

an aerodynamically efficient end; and, a drag-inducing surface at least substantially flush with the front surface of the fluid-ejection mechanism.

23. The device of claim 19, wherein the fluid-ejection mechanism is an inkjet printhead, and the fluid-ejection device is an inkjet-printing device.

24. A fluid-ejection device comprising:

a fluid-ejection mechanism having a front surface from which fluid is ejected; and, a component attachable to the fluid-ejection mechanism to at least one of minimize airflow and maximize airflow drag over the front surface of the fluid-ejection mechanism, wherein the component comprises a pair of drag-inducing surfaces at least substantially flush with the front surface of the fluid-ejection mechanism and situated at either side of the front surface of the fluid-ejection mechanism.

25. A fluid-ejection device comprising:

a fluid-ejection mechanism having a front surface from which fluid is ejected; and, means for minimizing airflow and maximizing airflow drag over the front surface of the fluid-ejection mechanism, the means maximizing airflow drag by employing at least one of: a plurality of ribs, a plurality of posts, and a rough surface.

26. The fluid-ejection device of claim 25, wherein the fluid-ejection mechanism is an inkjet printhead, and the fluid-ejection device is an inkjet-printing device.

27. A method comprising:

moving a fluid-ejection mechanism over a swath of media in a direction;

while the fluid-ejection mechanism is moving over the swath of the media in the direction, ejecting fluid onto the swath of the media from a front surface of the fluid-ejection mechanism;

diverting airflow around the fluid-ejection mechanism; and, relatively slowing airflow over a front surface of the fluid-ejection mechanism, by employing at least one of: a plurality of ribs, a plurality of posts, and a rough surface.

28. The method of claim 27, further comprising:

advancing the media to a next swath of the media;

moving the fluid-ejection mechanism over the media in an opposite direction over the next swath of the media;

while the fluid-ejection mechanism is moving over the next swath of the media in the opposite direction, ejecting fluid onto the next swath of the media from the front surface of the fluid-ejection mechanism;

diverting airflow around the fluid-ejection mechanism; and, relatively slowing airflow over a front surface of the fluid-ejection mechanism.

29. The method of claim 27, wherein ejecting fluid onto the swath of the media comprises ejecting ink onto the swath of the media.

30. A method comprising:

providing a fluid-ejection mechanism having a front surface from which fluid is ejected;

providing a component to minimize airflow and maximize airflow drag over the front surface of the fluid-ejection mechanism, the component comprising at least one of: a plurality of ribs, a plurality of posts, and a rough surface to maximize airflow drag; and, attaching the component to the fluid-ejection mechanism.

31. The method of claim 30, wherein providing the fluid-ejection mechanism comprises providing an inkjet-printing mechanism having the front surface from which ink is ejected.

32. The method of claim 30, wherein attaching the component to the fluid-ejection mechanism comprises fitting the component over the fluid-ejection mechanism.

33. The method of claim 30, wherein the component is to minimize airflow and maximize airflow drag over the front surface of the fluid-ejection mechanism in a first direction, the method further comprising providing a second component to minimize airflow and maximize airflow drag over the front surface of the fluid-ejection mechanism in a second direction opposite to the first direction.

34. The method of claim 33, wherein attaching the component to the fluid-ejection mechanism comprises attaching the component to a first end of the fluid-ejection mechanism, the method further comprising attaching the second component to a second end of the fluid-ejection mechanism.

35. A method comprising:

providing a fluid-ejection mechanism having a front surface from which fluid can be ejected;

forming at least one aerodynamically efficient leading surface on the fluid-ejection mechanism perpendicular to the front surface; and, forming at least one drag-inducing surface on the fluid-ejection mechanism substantially flush with the front surface.

36. The method of claim 35, wherein forming the at least one aerodynamically efficient leading surface of the fluid-ejection mechanism perpendicular to the front surface to divide airflow around the front surface comprises:

forming a first surface positioned before the front surface while the fluid-ejection mechanism is moving in a first direction; and, forming a second surface positioned before the front surface while the fluid-ejection mechanism is moving in a second direction opposite to the first direction.

37. The method of claim 35, wherein forming at least one drag-inducing surface on the fluid-ejection mechanism substantially flush with the front surface to relatively slow airflow over the front surface comprises:

forming a first surface positioned before the front surface while the fluid-ejection mechanism is moving in a first direction; and, forming a second surface positioned before the from surface while the fluid-ejection mechanism is moving in a second direction opposite to the first direction.

* * * * *